US009759521B2

(12) United States Patent
Carriere

(10) Patent No.: US 9,759,521 B2
(45) Date of Patent: Sep. 12, 2017

(54) FIREARM TRAINING APPARATUS AND METHOD

(71) Applicant: Force Training Solutions, Inc., San Jose, CA (US)

(72) Inventor: James Carriere, San Jose (CA)

(73) Assignee: Force Training Solutions, Inc., San Jose, CA (US)

( * ) Notice: Subject to any disclaimer, the term of this patent is extended or adjusted under 35 U.S.C. 154(b) by 186 days.

(21) Appl. No.: 14/820,712

(22) Filed: Aug. 7, 2015

(65) Prior Publication Data

US 2015/0354922 A1 Dec. 10, 2015

Related U.S. Application Data

(63) Continuation-in-part of application No. 13/894,750, filed on May 15, 2013, now abandoned.

(60) Provisional application No. 61/647,282, filed on May 15, 2012, provisional application No. 61/679,217, filed on Aug. 3, 2012, provisional application No. 61/717,236, filed on Oct. 23, 2012, provisional application No. 61/790,323, filed on Mar. 15, 2013.

(51) Int. Cl.

| | |
|---|---|
| ***F41G 3/26*** | (2006.01) |
| ***F41A 33/02*** | (2006.01) |
| *F41H 13/00* | (2006.01) |
| *F41J 5/14* | (2006.01) |

(52) U.S. Cl.
CPC ..... *F41G 3/2616* (2013.01); *F41A 33/02* (2013.01); *F41G 3/2655* (2013.01); *F41H 13/0012* (2013.01); *F41J 5/14* (2013.01)

(58) Field of Classification Search
CPC ..... F41G 3/26; F41G 3/2616; F41G 3/2655; F41A 33/00; F41A 33/02; F41A 33/04; F41A 33/06; F41H 13/0012; F41J 5/14
See application file for complete search history.

(56) References Cited

U.S. PATENT DOCUMENTS 4,983,123 A * 1/1991 Scott ..... F41A 33/02 362/111
2013/0319216 A1* 12/2013 Poirier ..... F41G 1/35 89/125

* cited by examiner

*Primary Examiner* — Timothy A Musselman
(74) *Attorney, Agent, or Firm* — Staniford Tomita LLP

(57) ABSTRACT

A firearm training apparatus and method provides simulated weapon realism that places higher priority to shot placement by using a culminated laser beam with specific target areas to achieve marksmanship accuracy. Trainee shooters can visually observe hits by an LED in the target area and hear an alarm sound when another trainee is hit. Stress and reaction to stress is achieved through the use of a TENS (transcutaneous electrical nerve stimulation) units in vests worn by the trainees. Greater realism is achieved by eliminating special safety equipment required with projectile systems, and focus on weapon accuracy and firing characteristics.

21 Claims, 12 Drawing Sheets

FIREARM TRAINING APPARATUS AND METHOD

CROSS REFERENCE TO RELATED APPLICATIONS

This application is a continuation in part of U.S. patent application Ser. No. 13/894,750, "Firearm Training Apparatus And Method" filed May 15, 2013, which claims priority to U.S. Provisional Patent Application No. 61/647,282, "Apparatus, System and Method For Improved Live Fire Simulation And Training" filed May 15, 2012, U.S. Provisional Patent Application No. 61/679,217, "Blank Firing Attachment Assembly For Automatic Rifles With Flash Suppressor" filed Aug. 3, 2012, U.S. Provisional Patent Application No. 61/717,236, "FTS Ocular Infrared Detection Glasses" filed Oct. 23, 2012 and U.S. Provisional Patent Application No. 61/790,323, "Firearm Training Apparatus And Method" filed Mar. 15, 2013. U.S. patent application Ser. Nos.: 13/894,750, 61/647,282, 61/679,217, 61/717,236 and 61/790,323 are hereby incorporated by reference in their entirety.

FIELD OF INVENTION

The present invention is directed towards a system for simulating firearm training.

BACKGROUND

Firearm simulation systems exist that use guns having a laser output and laser sensors to detect hits. Firearm simulation participants wear the laser sensors and shoot the laser gun at other participants. When a sensor worn by a participant is struck by a laser, the system can record the strike. This type of a simulation system can be known as a "force on force" system. Most force on force systems are basically laser tag systems that may user laser guns that are not similar to actual firearms. These systems may transmit an uncomfortable or painful signal to a user who has been hit by a laser beam. Even with the elimination of safety equipment, existing force on force firearm training systems fail to achieve the level of realism required to enhance the firearm training experience. Some existing systems place a strong emphasis on providing electrical shock as a means of informing the player that they have been shot. Because this electrical shock can be painful, the participant can practice the ability to "Fight through the Trauma". While certainly pain feedback can be important, the other aspects of realistic training have been ignored by prior art firearm training systems. What is needed is a more realistic firearm training simulation system.

SUMMARY OF THE INVENTION

Most laser engagement systems function on the design premise that a laser strike or hit renders the target acquired and the subject identified as a casualty. Hits are recorded without regard to marksmanship skills allowing deterioration of learned skills. Training focus is on the ability to fight through stress and less on target accuracy. Apart from other systems, the inventive firearm training apparatus and methods simulates weapon realism. The inventive apparatus can be implemented through conversion kits that allow users to convert their own live handguns into blank firing weapons that replicate all live fire characteristics. A uniquely designed blank round handgun chamber block used in semi-automatic handguns and muzzle adaptors used for AR Style weapons, allows the trainees to experience the effects of weapon fire without the risks of chambering live rounds.

In a handgun embodiment, the barrel and chamber block of a handgun are replaced with a blank round chamber block and a laser assembly. This replacement of components converts the handgun from a normal firearm to a simulated firearm device that feels like the user's handgun when shot but emits a laser beam rather than a bullet. The blank chamber block is substantially different than a normal chamber block. The blank chamber block has vents that reduces the internal pressure when the blank is fired and a leaf spring that slides against the slide of the handgun and moves the blank chamber block between blank rounds. The leaf spring can normally extend through the ejection slot. However, immediately after a blank is fired, the slide will move back relative to the frame, laser assembly and blank round chamber block. This will cause the leaf spring to contact an inner surface of the slide and exert a downward force that will help to move the blank chamber into a position to eject the used blank casing and insert a new blank.

The laser assembly can include: a laser, an actuation mechanism and a battery. When a blank is fired the actuation mechanism the actuation mechanism is actuated which causes the laser to emit a laser beam. The actuation mechanism can be: a pressure sensor, an audio sensor or any other sensor that can detect the firing of the blank round. The laser beam can be directed towards laser targets which can be placed on people or objects. When the laser beam hits a target, the laser beam is detected by sensors and provides hit feedback to the system. The inventive firearm training apparatus and method places higher priority to shot placement by using a culminated laser beam with specific target areas to achieve marksmanship accuracy. Fiber optic pads allow smaller target areas that are arranged over specific target areas. The targets may also be equipped with LEDs (or other visual indicators) and audio output devices. A shooter can visually observe hits as an illuminated LED in the target area and/or a sound alarm when hit. Stress and reaction to stress is achieved through the use of a TENS (transcutaneous electrical nerve stimulation) unit. Greater Realism is achieved by eliminating special safety equipment required with projectile systems, and focus on weapon accuracy and firing characteristics.

DETAILED DESCRIPTION

Figure 1:
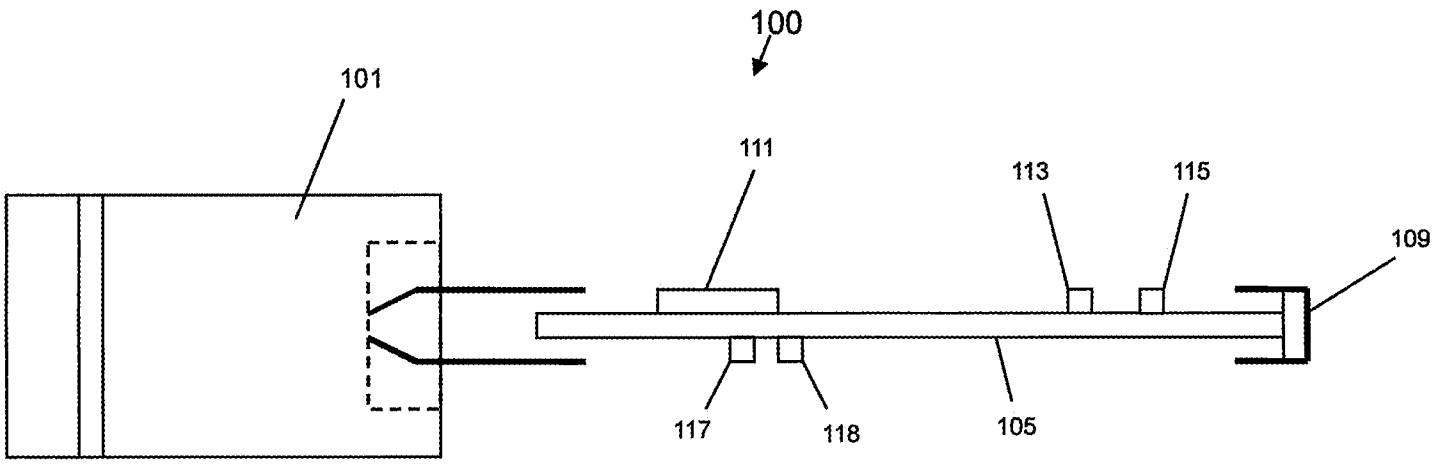
FIG. 1 illustrates an embodiment of a laser assembly.

The inventive firearm training apparatus and method were designed to realistically simulate actual firing of ammunition with a real firearm. In order to provide a realistic simulation, a real handgun and/or a long gun (rifle) are adapted for simulated firing so that the same operating principles and characteristics of the real weapon with life rounds are applied to the simulated actuation with blank rounds.

The inventive firearm training apparatus can include a blank round handgun chamber block that can be used to change a fully functional duty weapon firearm to a blank firing training weapon that emits a laser beam when the blank when the firearm is fired. The system can also include fiber optic pads that are worn by the system users to monitor the training participants and record laser beam hits. In an embodiment, the fiber optic pads can transmit the hit data to a computer which can record the laser beam hits associated with each trainee and provide information about the location of the hit and the source of the hit. Each laser can be encoded with a signal indicating the laser source and each sensor mechanism can transmit a signal identifying the sensor mechanism that received the laser hit. The system computer can match the laser source and the sensor identities to produce cumulative information regarding which laser hit which sensor which can then be used to produce reports that can describe many statistics which can include: the number of rounds fired, the accuracy of the shooter, the locations of the hits on the trainees, etc. A benefit of the inventive firearm training is that the trainees use the same weapons, magazines, and types of ammunition in the simulations as the actual firing of the firearms. Because the actual guns are used to fire blank ammunition, the feel, recoil and sound can accurately replicate the same guns firing live ammunition.

Existing force on force firearm training systems can provide target areas that cover the body area and in some cases these systems can inaccurately record hits that are beyond the target area because the size of the laser beam can be greater than the diameter of the live ammunition. Thus, these systems may inaccurately record simulated laser hits when actual ammunition would have missed the target. Having specific target areas on the subject is a feature of the inventive firearm training system. Thus, the inventive system may only record laser hits that would be hits using live ammunition. This improved hit reporting can reinforce marksmanship skills and ensure that the trainees receive accurate feedback and results for delivering lethal shots.

In an embodiment, the inventive firearm training system can include an ocular target device that is worn of the user's face and allows training participants to engage "T-zone" targets. In another embodiment, the inventive firearm training can include a target system that allows the use of vehicles in active shooter simulation scenarios. An ocular target system can be placed on one or more vehicles to transmit laser strikes to a laser sensor. The portable target system can be placed on side window or attached to vehicle headrests. The target box of both the ocular target device and the ocular target system can detect laser hits and transmit this information to the system computer to record the hits and hit sources.

The training vest apparatus can include a stress feedback mechanism which provides a physical signal to the trainee when struck by a laser hit during the training simulation. The physical signal can be an electrical signal that is managed through the use of a TENS (transcutaneous electrical nerve stimulation) unit. When a laser hit is detected by the training vest apparatus, the TENS unit can respond by delivering an electrical nerve stimulating pulse to nerves that have a wide range signal strengths. In different embodiments or feedback setting, the nerve stimulating pulse can range from a low setting that provides a numbing sensation to a high setting that can temporarily incapacitate a muscle group. Realism aspects of the inventive firearm training apparatus can be further enhanced by allowing the use of training environments and locations where training can be conducted. The inventive system can include equipment that can be used in any environment.

The inventive firearm training system uses features and technologies to achieve a realistic force on force firearm training system. In an embodiment, the inventive system includes an blank round handgun chamber block and laser assembly that are replace the barrel and chamber block assembly that change most semi-automatic handguns into blank firing weapons that fire blanks and emit a laser beam that accurately simulates the characteristics of a weapon firing live ammunition. Trainees can participate in the simulations using assigned weapons which build the skill sets required to master the user of a particular weapon.

In an embodiment, the a laser system utilizing a culminated coded laser adapted to a specialized housing that is adaptable to handguns and long guns and allows subject shoot where weapon is aimed. A fiber optic training vest used by the inventive system can provide visual, auditory, and tactile feedback when a subject wearing the vest is hit with a laser beam in a the targeted area. In an embodiment, the ocular target comprised of plastic glasses can be connected to the fiber optic vest that allows for that eliminates specific types of targets during "force on force" training exercises. In an embodiment, the inventive system can also include a portable target system that can attached to the side window or headrest of any vehicle.

The inventive firearm training system will be described with reference to the following drawings. FIG. 1 illustrates an embodiment of a laser assembly 100. The laser assembly can include: a laser module 101 attached to a printed circuit board 105 by means of a connecting washer 102. The printed circuit board 105 includes a micro controller 111 that can transmit the identification signals to the laser module 101. The transmission of the identification signals to the laser module 101 can be actuated by a pressure switch 115. In other embodiments, the laser module 101 can be actuated by an audio sensor 113 such as a microphone. The printed circuit board 105 is coupled to a battery 109 for powering the laser assembly 100 components.

The laser assembly 100 can also include a status light emitting diodes (LEDs). In this illustrated example, a first LED 117 can be used to indicate a power status and a second LED 118 can be used to indicate an active status of the laser. The first LED 117 and the second LED 118 can emit different colors to indicate the status of the laser assembly 100. For example, a green light may indicate that the laser assembly 100 is operating properly and a red light may indicate a problem.

Figure 2A:
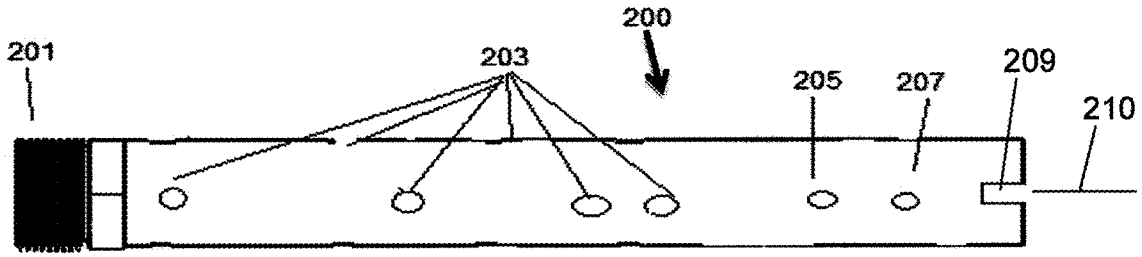
FIG. 2A illustrates a side view of an embodiment of a universal laser barrel housing assembly.
Figure 2B:
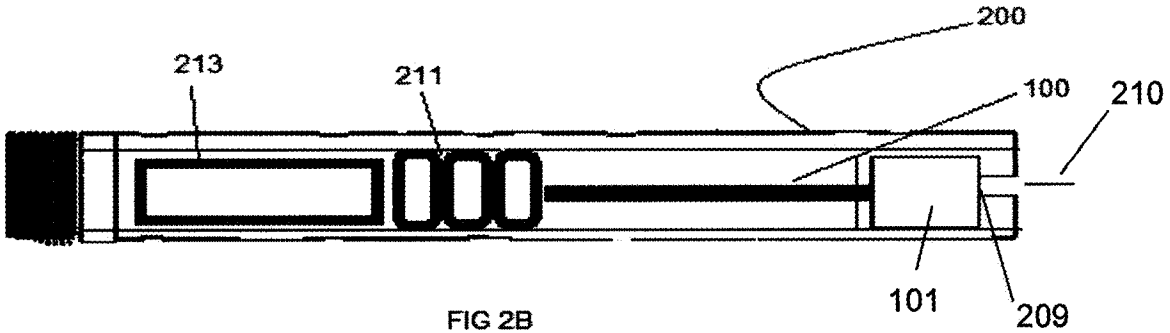
FIG. 2B illustrates a cross section view of an embodiment of a universal laser barrel housing assembly.

With reference to FIG. 2A, an embodiment of a laser housing 200 is illustrated and with reference to FIG. 2B, a cross section view of an embodiment of a laser housing assembly is illustrated. The laser housing 200 is designed to accommodate the laser assembly 100 and can have threads 201 which can be coupled to a blank chamber block. This laser housing and blank chamber block can replace the normal barrel and chamber block for semi-automatic pistols to create a firearm simulation device. Alternatively, the laser housing can be coupled to a muzzle assembly adapted for assault rifle (AR) style weapons.

The laser housing 200 can be used with a firearm that is shooting blanks. When the blank is shot, gunpowder or other explosive materials are ignited producing burning powder and generating high pressure gas. Some of this high pressure gas can directed to the outer surface of the laser housing 200 and some of the gas enters the vents 203. The change in pressure can be detected by the pressure switch and/or the sound energy from the blank can be detected by the audio sensor. The blank signals from the audio sensor or the pressure switch can actuate the laser assembly which causes the laser module 101 to emit a laser beam 210 that concentrically aligned with the cylindrical laser housing 200 from the laser port 209. The laser beam 210 is along the center axis of the cylindrical laser housing 200. The end of the laser housing 200 is solid. In order to utilize internal pressure from a fired blank, the laser housing 200 can include vent holes 203 which can allow the gases from the fired blank cartridge to enter through the vent holes 203 and flow into the housing 200 to actuate the pressure sensor and/or sound sensor devices on the laser assembly 100. The housing 200 can also provide user access to the electronic components on the laser assembly 100 to provide visible access to LED lights on the electronics which can indicate the status of the operational status of the electronics through a laser status LED viewing hole 207 and battery power through viewing hole 205. The laser housing contains a laser port 209 to insure true center for shot accuracy. FIG. 2B illustrates the laser housing assembly comprised of the laser housing 200, the laser assembly 100, batteries 211, and spacer 213.

Figure 3B:
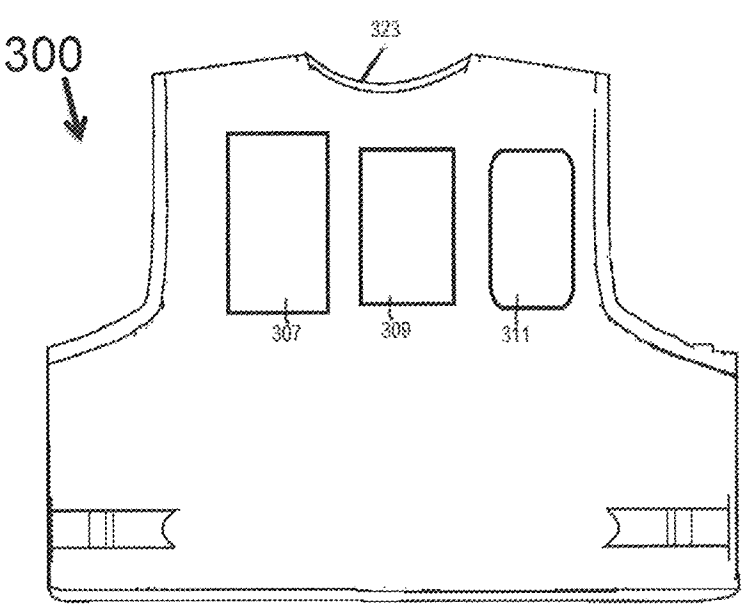
FIG. 3B illustrates a back view of an embodiment of a laser optical sensor training vest.
Figure 3A:
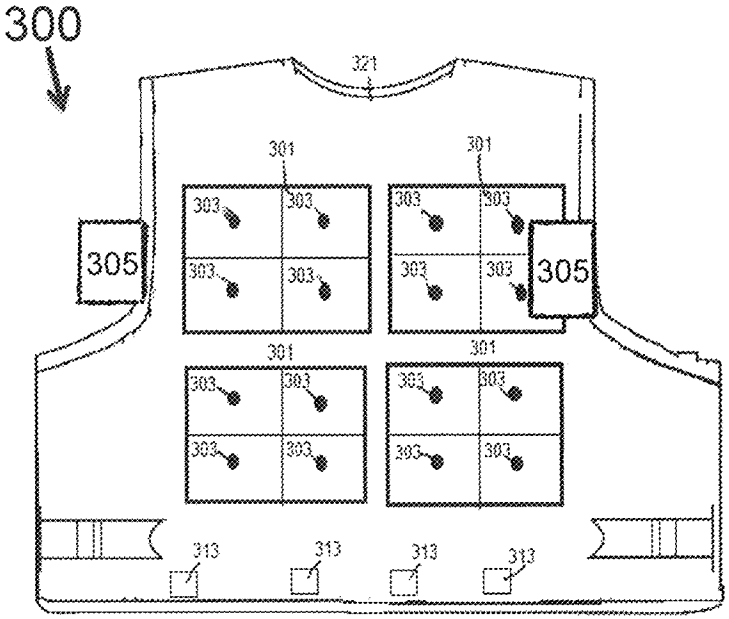
FIG. 3A illustrates a front view of an embodiment of a laser optical sensor training vest.

FIG. 3A illustrates a front view and FIG. 3B illustrates a back view of an embodiment of a fiber optic training vest 300 that can be worn by trainees. In an embodiment, the fiber optic training vest 300 can incorporate multiple fiber optical pads 301 that can be arranged in a target specific order to receive coded infrared laser hits from the blank firing training pistols or rifles. In an embodiment, the fiber optic training vest can indicate a laser beam hit by activating a light emitting diode (LED) 303 in a corresponding specific targeted area and activating a sound alarm when specific located optical pads 301 are hit with a gun or rifle fired infrared laser. The optical pads 301 can be made of a sheet of transparent or translucent plastic that can transmit laser light. In an embodiment, the LEDs 303 can be red.

The optical pads 301 and the LEDs 303 can be coupled to infrared detector sensor boards 305 which can process signals from the optical pads 301 and actuated the LEDs 303 when the optical pads 301 are hit with an infrared laser. The sensor boards 305 can be coupled to controller electronics 307. In the illustrated embodiment, the front of the vest 300 can include four separate optical pads 301. When the laser beam strikes the optical pad 301, the light is transmitted throughout the plastic material. Each optic pad 301 is connected by a fiber optic cable to a sensor board 305. Light travels through the optical pad 301 and an optic cable to the sensor board 305 that converts the light signal to an electrical output signal. In response to the laser hit signals, the sensor board 305 can transmit a signal to a controller(s) that controls user feedback devices. For example, a controller can trigger or actuate transcutaneous electrical nerve stimulation (TENS) 309. When the laser beams hit the fiber optical pads 301, the system can actuate the TENS 309 which can be stress inoculators that can enhance the training experience. The TENS 309 can be actuated by the controller electronics 307. Batteries 311 can power the vest 300 components.

In the illustrated embodiment, the front of the vest 321 can include the optical pads 301, the infrared detector sensor boards 305 and the back of the vest 323 can include the controller electronics 307, TENS 309 and batteries 311. In an embodiment, the vest 300 can be modified by adding additional optical pads 301 which can be added to the front of the vest 321 or the back of the vest 323. The vest 300 can include additional optical pad connectors 313 which can be used to connect additional optical pads 301 and detector sensor boards 305 to the vest 300.

Figure 4A:
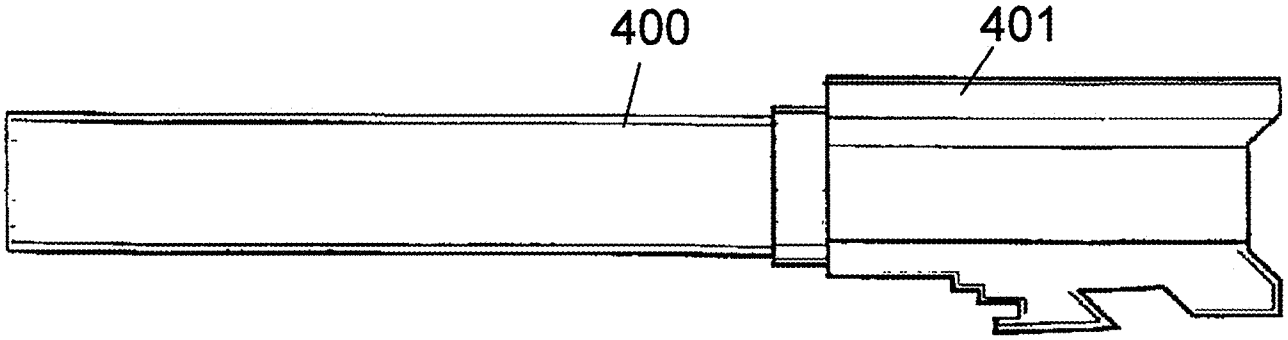
FIG. 4A illustrates a side view of a handgun barrel and chamber block assembly.

FIG. 4A illustrates a semi auto barrel design that is a component of the handgun that is replaced with the inventive design of the handgun chamber block and laser housing assembly. During use, a life round is placed in the chamber block 401 and when fired, a bullet is fired out of the chamber block 401 through the barrel 400 and out of the firearm. The slide can move backwards and the empty casing is then removed from the chamber block 401 and passes through an ejection slot in the slide. A live round can be automatically inserted into the chamber block 401 and the process is repeated.

Figure 4B:
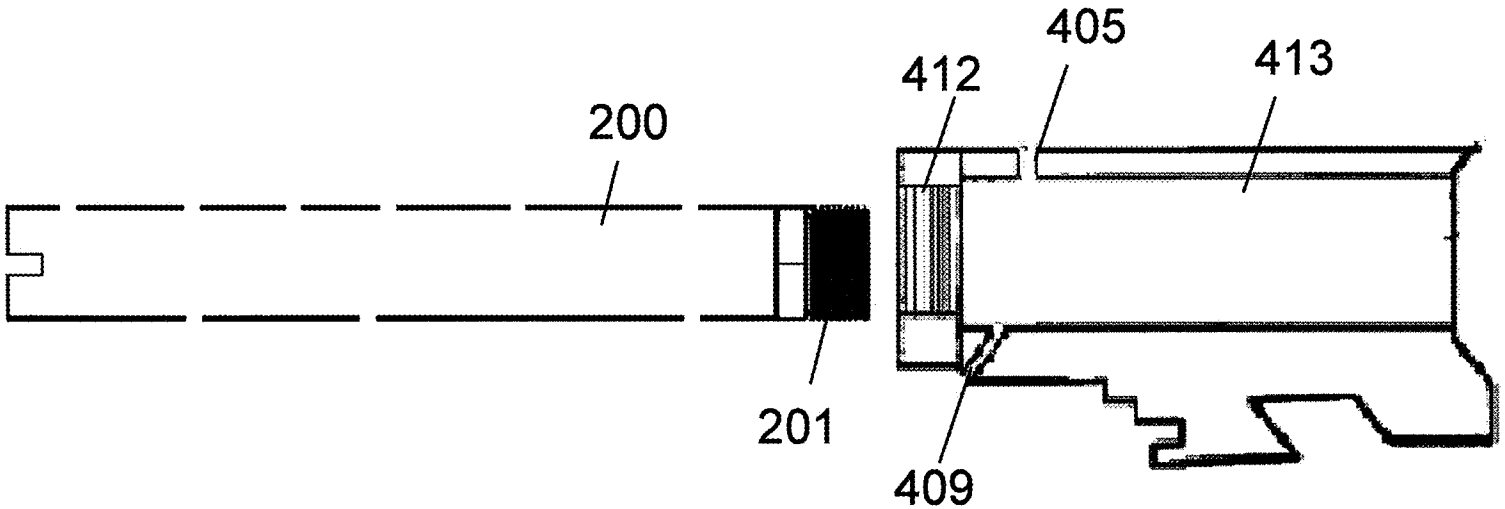
FIG. 4B illustrates a cross section side view of an embodiment of a laser housing and blank round chamber block.

As discussed, the barrel and chamber block 401 are replaced with a laser assembly and blank chamber block. FIG. 4B illustrates an embodiment of a blank round chamber block 413 which can be coupled to the laser housing 200 shown in FIGS. 2*a* and 2*b*. In the illustrated embodiments, the male threads 201 on an end of the laser housing 200 can be screwed into the female threads 412 in the handgun chamber block 401. The assembled laser housing 200 and handgun chamber block 401 can be placed in a barrel assembly of a handgun and blank round can be placed in the blank round chamber 413. When the trigger of the handgun is pulled, a hammer or striker can impact the back of the blank causing the blank to fire.

There are many differences between the chamber block 401 and barrel 400 illustrated in FIG. 4A and the illustrated embodiment of the inventive laser housing 200 and handgun chamber block 413 used only for simulated firearm use shown in FIG. 4B. More specifically, the barrel 400 is cylindrical structure that a bullet is fired from. In contrast the laser housing includes a laser and other electronic components uses the energy from the fired blank to actuate a switch that causes the laser to emit a beam of light. Although the blank chamber block 413 and laser housing 200 change the functionality, the inventive system is designed to provide an accurate simulation of firing live rounds. Thus, even though live rounds are not fired the blank chamber block 413 and laser housing 200 are designed to generate the required pressure when a blank is fired to replicate live fire characteristics of sound and recoil.

The blank round chamber block 413 can include an atmospheric vent 405, which provides a gas flow path directly from the blank round chamber 413 forward of the blank, for the direct discharge of gases from a fired blank round. The handgun chamber block 413 can also include a pressure switch vent 409 which is angled downward and is out of alignment with the laser housing 200. In contrast to the barrel and chamber block shown in FIG. 4A, gases from a fired blank do not flow directly from the blank round chamber block 413 into the laser housing 200. Gases from the blank round chamber block 413 can flow out of pressure switch vent 409 and from an area outside the laser housing 200 through the vent holes 203 into the laser housing 200. The gas flow into the laser housing 200 increases the internal pressure that is used to actuate the pressure switch in the laser assembly and any excess pressure can be vented out of the chamber block 401 through the pressure switch vent 409.

The described convoluted gas flow path out of the blank round chamber block 413 through the pressure switch vent 409 and into the laser housing 200 through the vents 203 can allow the laser housing 200 to be protected from the hot pressurization gases from the fired blanks. Thus, the designs of the blank round chamber block 413 and the laser housing 200 protect the sensitive electronic packages and components on the laser assembly in the laser housing. The handgun chamber block 413 eliminates the abutment surface 401 of the prior art. The elimination of the abutment surface 401 facilitates blow back operation of the slide.

In an embodiment the blank round chamber 413 can be a custom chamber used for specific types of blank cartridges. In these embodiments, the blank round chamber 413 can have internal surfaces which may only allow blanks having a corresponding shape to be used with the blank round chamber 413. This can be an important safety feature which can prevent users from accidentally attempting to use a live round with the blank round chamber 413. The inventive system would be destroyed and the user may be injured if a live firing round is placed in the blank round chamber 413 and fired.

When firing a blank round, the gases created by the burning powder must be vented in a manner that provides the proper amount of back pressure within the blank round chamber block 413, in order to control the amount of energy transferred from the expanding gasses into the gun slide. This venting can also protect the laser assembly in the laser housing 200 that contains sensitive electronic packages that cannot withstand the violent pressures and hot gas flow from a gun powder discharge. Thus, other means of gas venting can be provided which diverts the hot gases from the laser barrel housing assembly pathway. The system should also allow the gun to operate successfully in blowback operation by providing the firing and semiautomatic operation of a normal ballistic fired momentum transferred operation. By strategically configuring the vent hole(s) 405 of the blank round chamber block 413 to vent out the top of the gun chamber, the gas energy can be directly transferred as recoil and noise. The recoil and noise parameters are required for training purposes to allow the gun in laser simulation mode to act like the actual gun and provide the feel of firing a live bullet based round. Capturing the expanded gases within the blank round chamber block 413 also allows maximum energy to be utilized to move the slide back and control the laser housing 200 and blank round chamber block 413 position for a successful ejection and reloading of a new blank round. Placing the vent hole 405 directly in the blank round chamber block 413 allows the vent hole 405 diameter to be specified and optimized to the correct size, in order to balance barrel spring loads, gun recoil, gun noise, and the ejection and loading of new rounds for semi-automatic gun performance.

Figure 5:
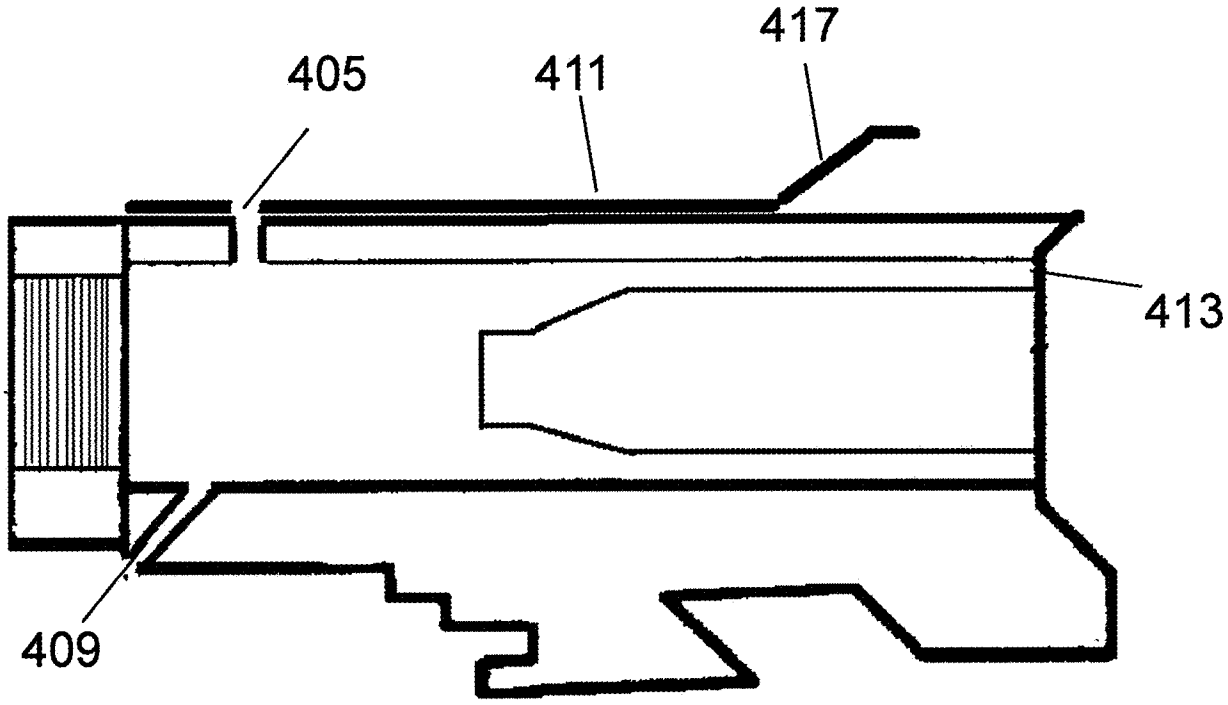
FIG. 5 illustrates a cross section side view of a blank round chamber block and leaf spring coupled to the blank round chamber block.

FIG. 5 illustrates an embodiment of a blank round chamber block 413 that includes a leaf spring 411 that is physically attached to the top surface. In this embodiment, a leaf spring 411 can include a slanted portion 417 and the leaf sprint 411 can be secured to the top of a handgun barrel block 401 to force the barrel chamber block 401 into its correct load and eject position. thru the motion of the slide over the slanted portion 417 of the leaf spring 411. In order to facilitate the rearward motion of the barrel block 401, a spring resistant device can be placed in the path of the rearward moving slide in order to allow the slide force to catch the barrel motion and move the barrel in a backward motion. A spring 411 or a spring type device attached to the barrel 401 can catch the slide rearward motion and converts the slide energy into a rearward motion of the barrel. Furthermore the spring 411 can allow for a smooth transfer of the slide energy through the deformation of the spring 411, which avoids a destructive impact type transfer, if a solid material was used in the transfer of energy from the motion of the slide to the barrel block 401 motion.

In order to accommodate the leaf spring 411, the height of the blank round chamber block 413 can be lower than a normal barrel block (shown in FIG. 4A). The upper surface of the blank round chamber block 413 may not contact the inner surface of the slide 221 and the slanted portion 417 of the leaf spring 411 can extend out of the ejection slot in the slide. However, when a blank has been fired and the slide 221 moves backwards relative to the blank round chamber block 413, the angled portion of the leaf spring 411 can be moved out of alignment with the ejection port and contact an inner surface of the slide 221 which exerts a downward force on the blank round chamber block 413. When the slide 221 returns to its normal position, the angled slanted portion 417 of the leaf spring 411 can be moved back into alignment with the ejection port.

Figure 6A:
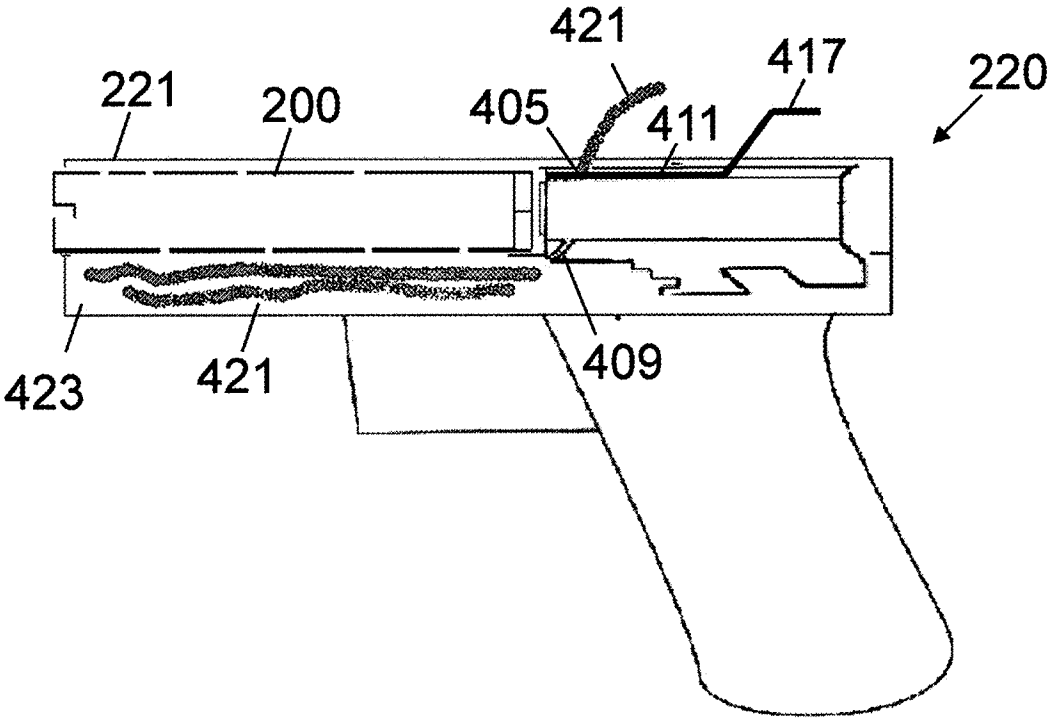
FIG. 6A illustrates a cross section side view of an embodiment of handgun configured with a laser housing and blank round chamber block illustrating gas vent paths.

FIG. 6A illustrates a cross sectional side view of a handgun 220 where the barrel has been replaced with the laser housing 200 and a blank round chamber 413. When the blank is fired, gas 421 from the blank is vented through the atmospheric vent hole 405 which immediately exits the handgun 220. Some of the gas 421 from the fired blank is also vented through the pressure switch vent 409 which directs the gas 421 into a space between the laser housing 200 and the frame 223 of the handgun 220. This gas 421 also flows through the vent holes 203 in the laser housing 200 where the pressure increase is detected by a pressure switch on the printed circuit board. The increased pressure actuates the pressure switch which causes the laser module to emit a laser light output from the handgun 220. The junction of the laser housing 200 and the blank round chamber 413 is a solid structure so that gas from the fired blank do not flow directly from the interior of the blank round chamber 413 to the interior of the laser housing 200.

Figure 6B:
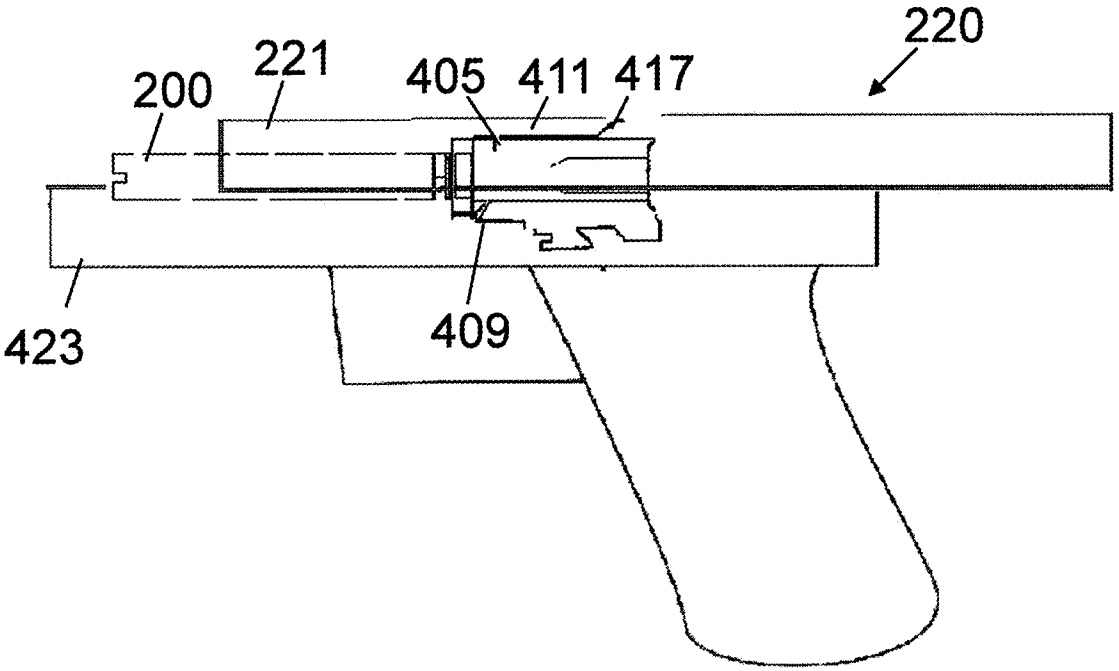
FIG. 6B illustrates a cross section side view of an embodiment of handgun configured with a laser housing and blank round chamber block illustrating slide movement after a blank round is fired.

During normal operation, the slanted portion 417 can extend out of the ejection port of the handgun slide. However, when the blank is fired, the explosion of the gun powder is directed forward and causes the blank casing to move backwards against the slide 221 portion of the handgun. FIG. 6B illustrates how the spring forces the blank round chamber block 413 downward as slide 221 moves rearward. The force of the fired blank causes the slide 221 to move backwards relative to the blank round chamber 413. The blank firing force also moves the blank casing out of the blank round chamber 413 and out the ejection port in the slide 221. As the slide move backwards, the slanted portion 417 will slide under a forward edge of the ejection port and flatten against the upper surface of the blank round chamber 413. This compression of the slanted portion 417 of the leaf spring 411 will result in a downward force on the chamber block 401. As the slide 221 returns to its normal position, the slanted portion 417 of the leaf spring 411 returns to the ejection port area of the slide 221 and returns to its normal position.

The leaf spring 411 can be very important in that it not only helps to reverse the motion of the blank round chamber 413 from a forward motion to backward motion, but it also imparts a downward force which assist the blank round chamber 413 to move downward, as required. This downward position of the blank round chamber 413 is important for ejecting the used round from the blank round chamber 413 and the loading of a new live round from the gun magazine. Also, the size of the spring 411 and stiffness of the allows for balancing the energy transferred from the fired blank round to the blank round chamber 413 and slide 221 motion; thereby controlling the amount of gun recoil and gun sound level.

Figure 7:
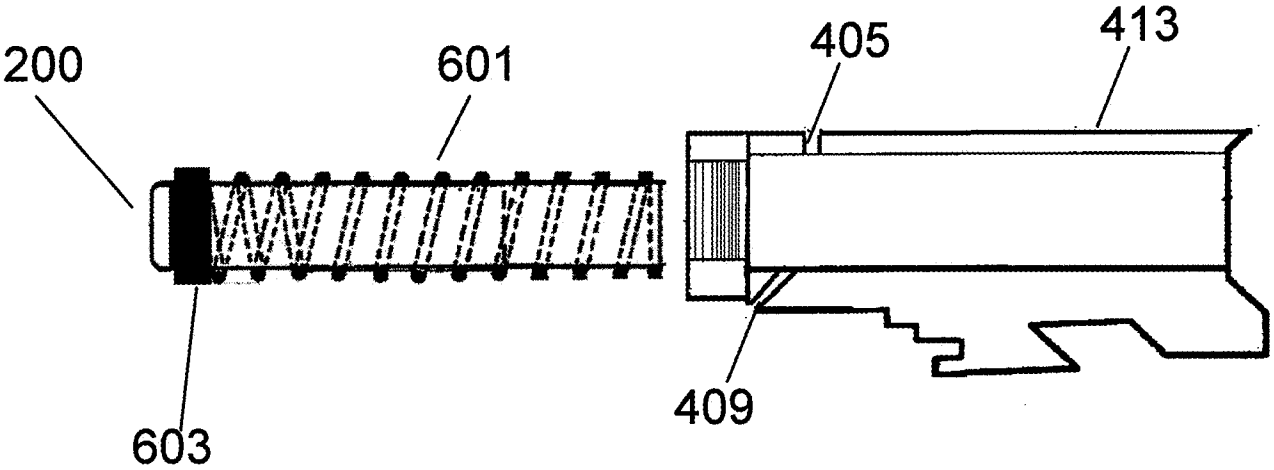
FIG. 7 illustrates an embodiment of a compression spring used with a laser housing assembly and blank round chamber block.

FIG. 7 Illustrates a compression spring 601 surrounding the laser barrel housing 200 that is coupled to a blank round chamber 413. In an embodiment, a helical compression spring 601 can be placed over the laser barrel housing 200 of the firearm, to force the blank round chamber 413 into its correct new blank load and used blank eject position. The front portion of the compression spring 601 can be coupled to the front of the slide with the front portion of the laser housing 200 can extend out of the front of the slide. When the blank is fired, the slide can move backwards relative to the laser housing 200 and blank round chamber block 413 which causes compression of the spring 601, by the rearward motion of the gun slide.

In order to facilitate the rearward motion of the blank round chamber block 413, a spring 601 is placed in the path of the rearward moving slide, in order to allow the slide force to transfer its rearward motion to the blank round chamber 413 and move the blank round chamber 413 in a backward motion. In the illustrated embodiment, an end of the coiled compression spring 601 can be attached to the blank round chamber 413 and can catch the slide's rearward motion and converts the slide energy into a rearward motion of the blank round chamber 413. Furthermore the spring 601 can allow for a smooth transfer of the slide energy through the deformation of the spring 601, which avoids a destructive impact type transfer which can occur if a solid material was used in the transfer of energy from the motion of the slide to the blank round chamber 413 motion. The compression spring 601 can also be important because it not only reverses the motion of the blank round chamber 413 from a forward motion to backward motion, but also allows for the balancing of energy transferred from the fired blank round to the blank round chamber 413 and slide motion, thereby controlling the amount of gun recoil and gun sound level. For some firearms, a nose piece 603 can be required around the front of the smaller diameter laser housing 200 to keep the laser housing 200 centered with the gun slide and receiver to assure the laser beam is on gun centerline which is required for accurate laser aiming. The nose piece 603 can also be used to keep the compression spring 601 from protruding thru the hole at a front end on the gun slide.

Figure 8A:
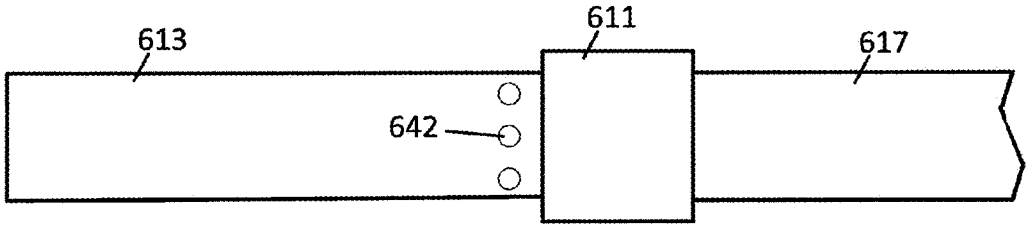
FIG. 8A illustrates a side view of an embodiment of a Muzzle Assembly for Automatic Rifles style weapons.
Figure 8B:
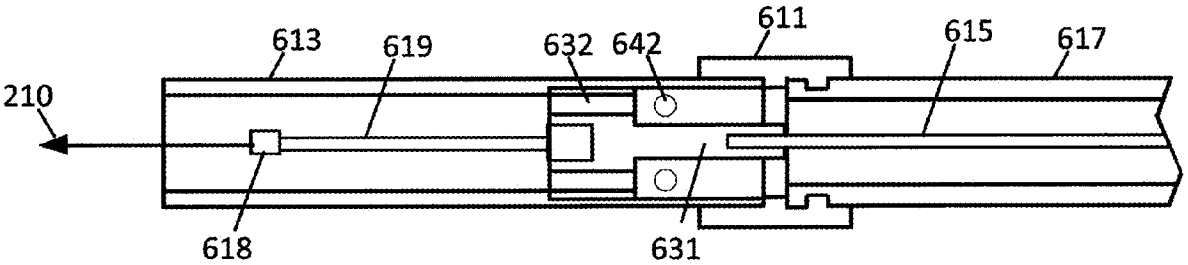
FIG. 8B illustrates a cross section side view of an embodiment of a Muzzle Assembly for Automatic Rifles style weapons.

FIG. 8A illustrates a side view of an embodiment of a muzzle body 613 for automatic rifles attached to a flash suppressor 617. The end of the muzzle body 613 can be threaded and screwed into the coupling nut 611 which is attached to a flash suppressor 617 mounted on an end of a barrel of the automatic rifle. The muzzle body 613 can have a plurality of vent holes 642 that allow some of the gases from a fired blank to escape. With reference to FIG. 8B a cross section side view of the muzzle body 613 and flash suppressor 617 is illustrated. A safety rod 615 extends through the flash suppressor 617 and the entire length of the barrel of the rifle to prevent a user from accidentally putting a live round in the rifle. The gas flow restrictor 631 slides into the muzzle body 613 and presses against a shoulder within the muzzle body 613. The gas flow restrictor 631 can also be coupled to the end of the safety rod 615. A portion of the coupling nut 611 can be pressed into the grooves on an end of the flash suppressor 617 to secure the muzzle body 613 to the flash suppressor 617.

Figure 8C:
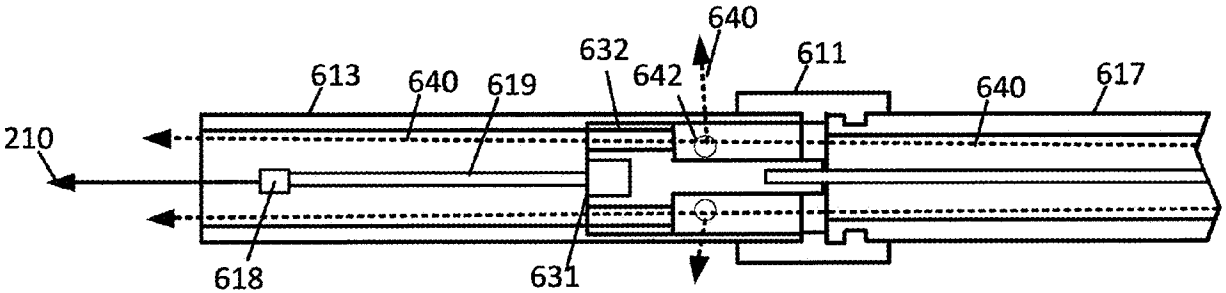
FIG. 8C illustrates a side view of Muzzle Assembly for Automatic Rifles style weapons.

With reference to FIG. 8C, a cross sectional view is illustrated. When the muzzle 613 is attached to the flash suppressor 617 with the coupling nut 611 and a blank round is fired, most of the gases 640 from the fired blank flow through the flash suppressor 617 to the gas flow restrictor 631. The bulk of the gas from the fired blank is required to cycle the rifle. The AR type firearm can use a gas system where most of the gas follows back to the chamber to push the bolt back to cycle the weapon. The gas flow restrictor 631 has small vent holes 632 that allow some of the gas 640 from the rifle barrel and flash suppressor to flow into the muzzle 613 and actuate a pressure switch on the laser assembly 619. In response to gas 640 transmitted through the vent hole(s) 632, a pressure switch on the laser assembly 619 can be actuated causing a laser 618 to emit a laser beam 210 from the end of the muzzle 613 that can be directed in the same path as a live round fired from the rifle.

The laser beam 210 is concentric and aligned with a center axis of the cylindrical muzzle 613, flash suppressor 617 and barrel of the rifle. The inventive system can provide highly accurate laser beam 210 path that is in alignment that matches the path of a live bullet fired from the rifle because the laser 618 is on the center axis of the cylindrical muzzle 613, flash suppressor 617 and barrel of the rifle. This configuration is substantially different than U.S. Patent Application Publication No. 2003/0175661 which discloses a system where the laser attached to an upper surface of a rifle. The laser beam emitted by the laser is parallel to the barrel of the rifle but out of alignment with the center axis of the barrel and flash suppressor. U.S. Patent Application Publication No. 2003/0175661 also does not require vents in the muzzle or a gas flow restrictor 631 because the electrical components of this system are not in the path of the gases from the fired blank. Thus, there is no need or suggestion of vent or gas flow restriction mechanisms because the electrical components are not in the gas flow path.

Figure 9:
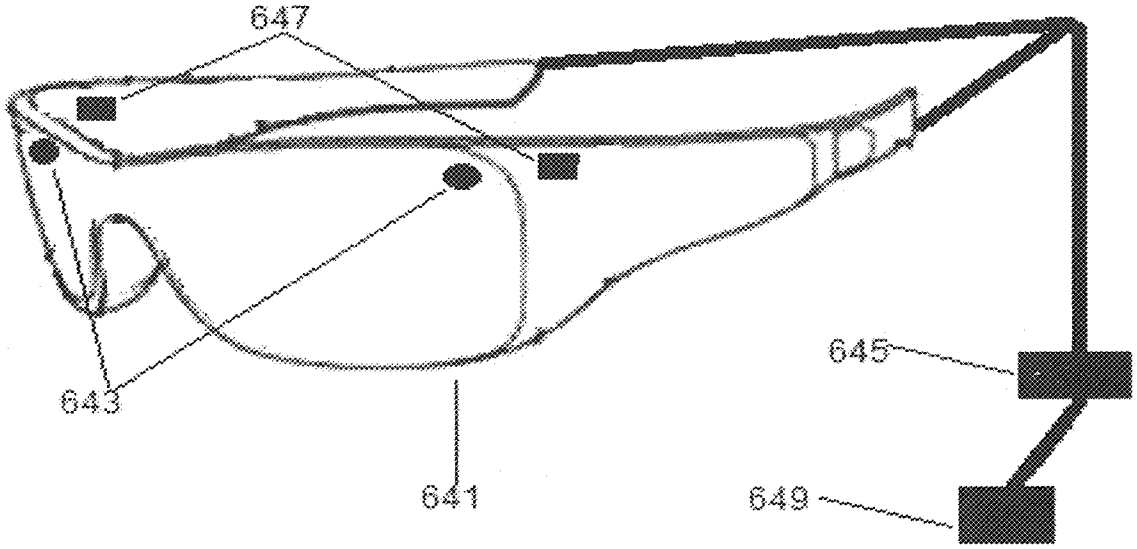
FIG. 9 illustrates an embodiment of Ocular Infrared Detection Glasses with laser strike detection sensors.

FIG. 9 illustrates an embodiment of ocular target assembly 640 that can include infrared (IR) sensors mounted on the glasses 641. The IR sensors 643 can be in communication with an infrared receiver 645 and these components can be powered by a battery 649 or other power supply. A laser beam can be emitted from a handgun or a rifle equipped with the laser assembly (as described above) during the firing of a blank round toward a person wearing the ocular target assembly 641. When the laser beam strikes on any part of the glasses 641 surface, the light from the laser enters the transparent glasses 641 and some of the light travels through the glasses 641. This light is detected by mounted IR sensor(s) 643 which sends an electrical signal through wires to the sensor receiver 645. The sensor receiver 645 can confirm that the laser signal contains the correct code and signal strength confirming a laser strike from an authorized laser source. The sensor receiver 645 then actuates the LED light(s) 647 on the glasses 641 to be turned "on" to confirm an accurate and correct strike. The glasses 641 can be made from Lexan™ and can be directly coupled to the laser detection sensors 643.

Figure 10B:
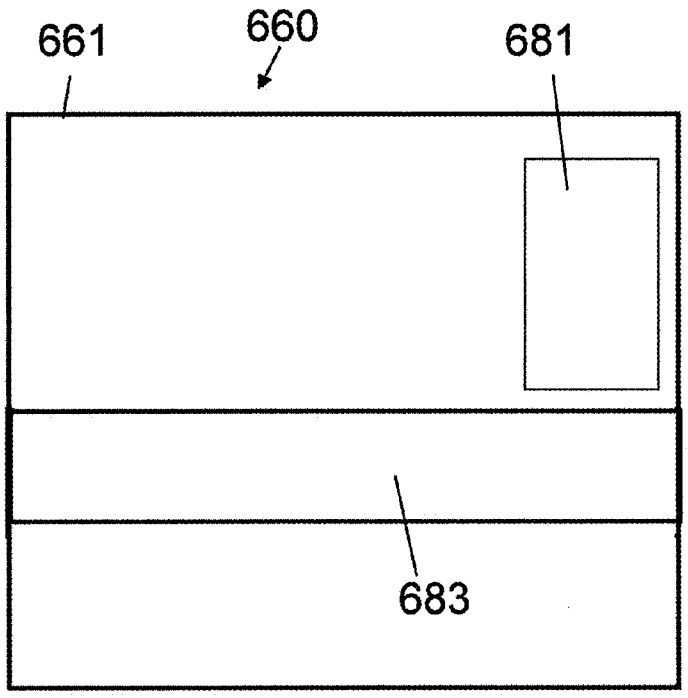
FIG. 10B illustrates a rear view of an embodiment of a Portable Target System.
Figure 10A:
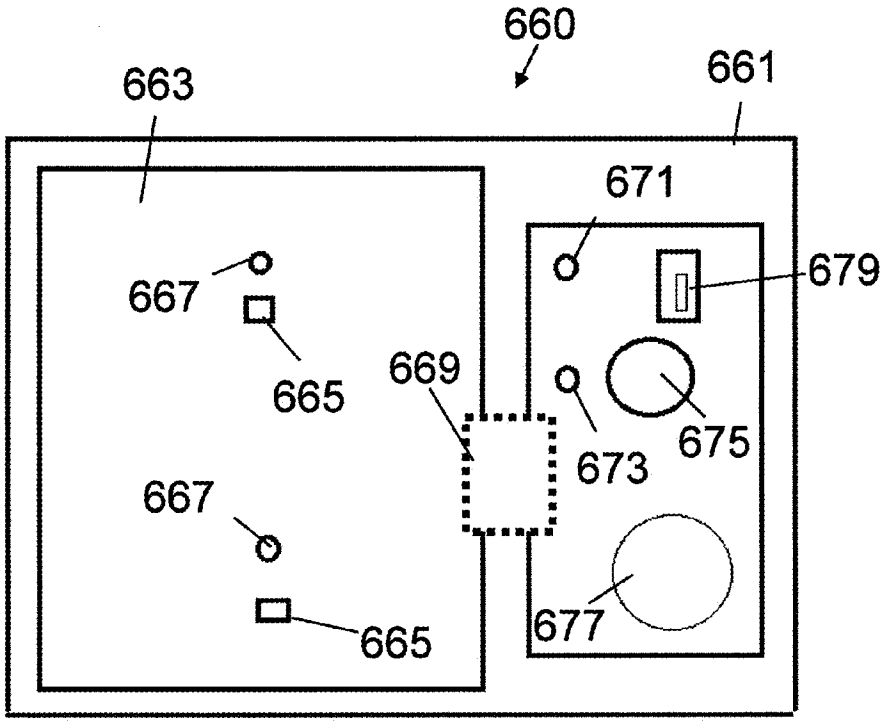
FIG. 10A illustrates a front view of an embodiment of a Portable Target System.

FIG. 10A illustrates a front view and FIG. 10B illustrates a back view of a portable, self contained, infrared laser detection system 660 comprised of: a plastic molded box 661, plastic mounting plate 663, assembled with laser detectors 665 and LEDs 667 attached to a sensor assembly 669 connected to a controller containing a power indicator LED 671, hit indicator 673, reset button 675 alarm 677 and power switch 679. The detection system is power by a battery pack 681 located in rear of unit. The detection system can be attached to object using the strap 683 located in rear of box. Infrared detection sensors 661 can be mounted in direct physical contact with a plastic infrared receiving and transmission plate 663. The sensors 661 may be infrared sensor chips which are mounted on the back of a window box plastic receiver plate. Sensors 661 can be arranged in a target specific order to receive coded infrared laser hits from a blank firing training pistol or rifle. The sensors 661 can be coupled to detector sensor electronics 665 which can be coupled to controller electronics 667. When the infrared detection sensor 661 is hit with a laser, the hit signal is transmitted from the sensor 661 to the detector sensor electronics 665 which can illuminated the LED 659 to provide a visual indication of the laser hit. A battery 669 can power the components of the laser detection system 660.

This window box system can be used in conjunction with a pistol or rifle incorporated infrared laser module, designed and integrated with a printed circuit board, to activate the firing of a coded infrared laser beam. The infrared laser beam sends a coded signal when activated by a pressure sensitive switch or a sound sensitive switch, when using a blank firing pistol or rifle.

The ocular laser hit detection system described above with reference to FIG. 9 and the self contained infrared laser detection system described above with reference to FIGS. 10A and 10B are substantially different than the fiber optic training vest laser hit detection system described above with reference to FIGS. 3A and 3B. The ocular system and the self contained infrared laser detection system utilize light sensors physically attached directly to transparent plastic structures. When the laser light contacts the transparent plastic structure, the laser light enters and is transmitted throughout the transparent plastic structure. The distance that the light is dispersed within the transparent plastic structure can vary with the intensity of the light beam, the plastic material and the sensitivity of the sensor. In an embodiment, the light beam may disperse up to about 8 inches. Thus, in some embodiments, light sensors can be placed within 8 inches of at least one or more light sensors on the transparent structure so that any laser hit will be detected by at least one light sensor. A light sensor detects the light transmitted through the plastic structure and converts the light sensor signal into an electrical signal that is transmitted through a wire to a sensor receiver.

In contrast to the light sensors in direct physical contact with the transparent plastic structures, the fiber optic training vest described above with reference to FIGS. 3A and 3B utilizes optical pads which include many optical fibers which are coupled to the optical pad. When laser light strikes the optical pad, the light is transmitted from the optical pads to the optical fibers to the sensor board. Because light must travel through the optical pad and optical fiber, the light much have a fairly high energy level. All output devices can be coupled to the sensor board through electrical cables. Therefore optical pad embodiments require a large number of optical fibers in order to detect and transmit laser strikes to more light sensors mounted on the sensor board.

However, in other embodiments a vest worn by a user can be include a plurality of targets made of transparent plastic sheets. Each of the transparent plastic sheets are in direct physical contact with one or more laser light sensors as described above. When the laser light contacts the transparent plastic sheet, the light is transmitted through the transparent plastic sheet and detected by the sensor in direct physical contact with the plastic sheet. The sensor can convert the light signal into an electrical signal that is transmitted through a wire to a sensor receiver. The sensor receiver can confirm that the laser signal contains the correct code and signal strength confirming a laser strike from an authorized laser source. The sensor receiver can then actuates an LED light(s) on the transparent plastic sheet to confirm a laser strike in the location of the strike.

Thus, all of the described laser strike sensors can utilize either light sensors in direct contact with the transparent target material or targets that are coupled to optical fibers that extend from the target to one or more infrared sensor receivers. For example in an embodiment, an ocular glasses system can include transparent be connected to an optical cable that is attached to a light sensor on the infrared sensor receiver. In this embodiment, the sensor is not in direct physical connection with the transparent plastic of the glasses. A portable, self contained, infrared laser detection system can also include a plastic receiving and transmission plate that can be connect via an optical fiber connecting cable to a light sensor on the sensor receiver. Again, in this embodiment, the sensor is not in direct physical connection with the target struck by the laser.

Figure 11B:
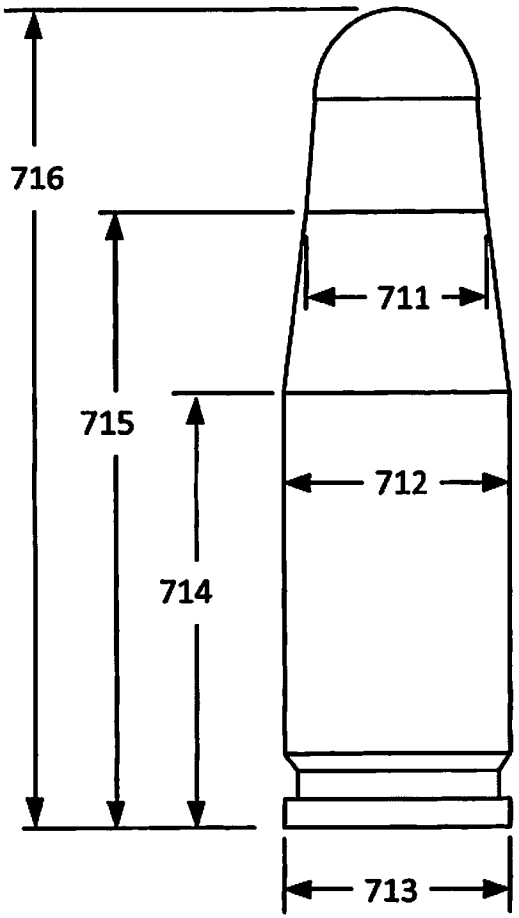
FIGS. 11A and 11B illustrate side views of embodiments of uniquely formed blanks used with a handgun chamber block for semi-automatic pistols.
Figure 11A:
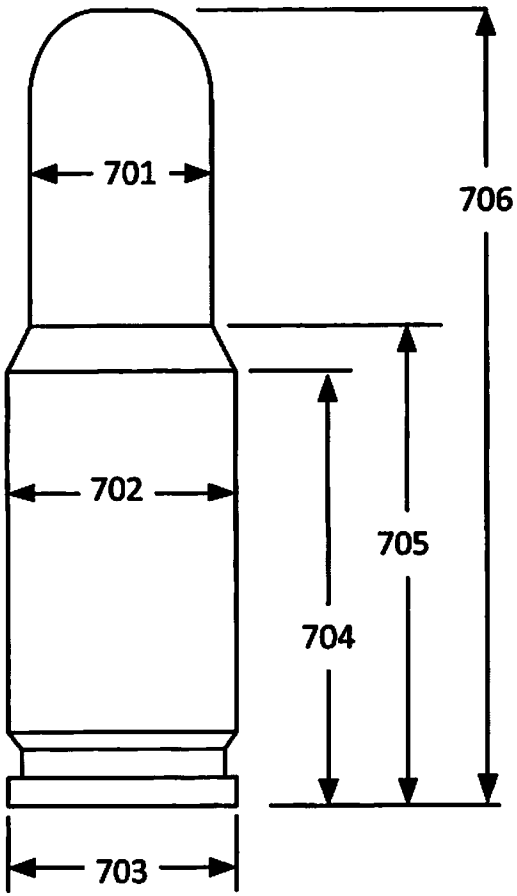

FIGS. 11A and 11B illustrate side views of embodiments of specially formed blanks used with firearms during the simulation training FIG. 12A illustrates a 9 mm blank that can be formed from a 9 mm win mag case. Similarly, FIG. 12B illustrates a 0.40 caliber blank that can be formed from a 10 mm mag case. Each of these rounds can be formed with special dies and can conform to uniquely reamed chambers. In an embodiment, the illustrated shoulder can be added to the blank so that it conforms to the contour of the internal surface of the blank round chamber block described above. Another feature of the inventive blanks is the narrow top of the blank which prevents live rounds from being chambered. A standard profile blank that would fit a standard chamber may not properly function with the modified training guns. Because of these special configuration features, no other commercially available blank will fit into the corresponding reamed chambers. With reference to Table 1 below, the dimensions of the reference numbers in FIG. 12A for a 9 mm are listed.

TABLE 1

| 701 | 702 | 703 | 704 | 705 | 706 |
|---|---|---|---|---|---|
| 0.322 inch | 0.372 inch | 0.388 inch | 0.625 inch | 0.700 inch | 1.140 inch |

In this embodiment, the outer diameter of the 9 mm specially formed blank case 702 is 0.372 inch. In contrast, a 9 mm live round can have a case diameter of 0.386 inch. In an embodiment, the blank round chamber block 413 described above can be used with 9 mm blanks and have inner diameter that is 0.380 inch that only allows the blank round to be inserted. Because the inner diameter (0.380 inch) of the blank round chamber block 413 is smaller than the outer case diameter of a live round (0.386 inch), the live 9 mm round cannot be placed in the blank round chamber block 413.

With reference to Table 2 below, the dimensions of the reference numbers in FIG. 12B for a 10 mm are listed.

TABLE 2

| 711 | 712 | 713 | 714 | 715 | 716 |
|---|---|---|---|---|---|
| 0.330 inch | 0.410 inch | 0.425 inch | 0.631 inch | 0.825 inch | 1.125 inch |

In this embodiment, the outer diameter of the 10 mm blank case 712 is 0.410 inch. In contrast, a 10 mm live round can have a case diameter of 0.423 inch. In an embodiment, the blank round chamber block 413 described above can be used with 10 mm blanks and have inner diameter that is 0.416 inch that allows the 10 mm blank round to be inserted. However, because the inner diameter of the blank round chamber block 413 (0.416 inch) is smaller than the outer case diameter of a live round (0.423 inch), the live 10 mm round cannot be placed in the blank round chamber block 413. Thus, the blank round chamber block 413 can prevent the accidental use of live rounds when a handgun has been modified by replacing the barrel and chamber block with the laser assembly and blank round chamber block 413 as described.

The present disclosure, in various embodiments, includes components, methods, processes, systems and/or apparatus substantially as depicted and described herein, including various embodiments, sub combinations, and subsets thereof. Those of skill in the art will understand how to make and use the present disclosure after understanding the present disclosure. The present disclosure, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation. Rather, as the following claims reflect, inventive aspects lie in less than all features of any single foregoing disclosed embodiment.

What is claimed is:

1. A firearm simulation system comprising:

a laser apparatus comprising:

a laser housing;

a blank round chamber block coupled to the laser housing, the blank round chamber block has a pressure switch vent that is angled downward and out of alignment with a center axis of the laser housing;

a laser emitting a laser beam concentrically aligned with the center axis of the laser housing;

a pressure switch within the laser housing that is actuated when a blank round in the blank chamber block is fired by pressurized gas that exits the pressure switch vent and enters the laser housing through vent holes; and a laser that emits a laser beam when the pressure switch is actuated, wherein the laser beam is aligned with the center axis of the laser housing; and a laser target having a laser sensor detecting laser strikes.

2. The firearm simulation system of claim 1 wherein the laser target is an ocular laser detection system comprising:

glasses worn by a user wherein the laser sensor is in direct physical contact with the glasses for detecting contact of the laser beam with the glasses;

a laser sensor receiver coupled to the laser sensor; and an ocular output device coupled to the sensor receiver wherein the ocular output device is actuated by the sensor receiver when the laser sensor detects contact between the laser beam and the glasses.

3. The firearm simulation system of claim 1 wherein the laser target is a vehicle mounted laser detection system and the laser sensor is in direct physical contact with a sheet of transparent plastic for detecting contact of the laser beam with the sheet of transparent plastic comprising:

a vehicle sensor receiver coupled to the laser sensor; and a vehicle output device coupled to the vehicle sensor receiver wherein the output device is actuated by the vehicle sensor receiver when the laser sensor detects the laser beam.

4. The firearm simulation system of claim 1 wherein the laser target is a wearable laser detection system comprising:

optical pads for detecting the laser beam from the laser apparatus;

optical fibers having first ends coupled to the optical pads and second ends coupled to the laser sensor;

detector sensor electronics coupled to the laser sensor; and a wearable output device coupled to the detector sensor electronics wherein the output device is actuated by the detector sensor electronics when the laser beam contacts the optical pads.

5. The firearm simulation system of claim 1 wherein the ocular output device is a light emitting diode (LED) that is illuminated when the laser sensor detects the laser beam.

6. The firearm simulation system of claim 1 wherein the laser apparatus is part of a conversion kit that replaces a barrel and a chamber block of a firearm.

7. The firearm simulation system of claim 1 wherein a leaf spring is in direct physical contact with the blank round chamber block and the leaf spring includes an angled portion that extends out of an ejection portion of a slide of a firearm before a blank round in the blank round chamber block is fired and the angled portion contacts an inner surface of the slide immediately after the blank round in the blank round chamber block is fired, compresses the leaf spring and moves the blank round chamber block downward into a correct load and eject position.

8. The firearm simulation system of claim 1 wherein the laser apparatus includes a compression spring fitted over the laser housing to move the blank round chamber block into a correct load and eject position.

9. The firearm simulation system of claim 1 wherein the laser apparatus further comprises:

a muzzle having muzzle vents that extend through an outer cylindrical surface of the muzzle;

a coupling nut in direct physical contact with the laser muzzle and a flash suppressor on a firearm;

an audio sensor within the laser muzzle that detects audio signals wherein the is actuated when a blank round is fired;

a gas flow restrictor at least partially within the laser muzzle having a gas flow restrictor vent for restricting gas flow into the muzzle; and a laser assembly within the muzzle, the laser assembly includes a laser emitting a laser beam that is aligned with a center axis of the muzzle and an audio sensor that is coupled to the laser that actuates the laser.

10. A firearm simulation system comprising:

a laser apparatus comprising:

a blank round chamber block wherein the blank round chamber block has a pressure switch vent that is angled downward and out of alignment with a center axis of the laser housing;

a laser housing coupled to the blank round chamber block;

a pressure switch within the laser housing that is actuated when a blank round in the blank chamber block is fired by pressurized gas that exits the pressure switch vent and enters the laser housing through vent holes;

a laser coupled to the pressure switch that emits a laser beam when the pressure switch is actuated wherein the laser beam is aligned with a center axis of the laser housing; and a leaf spring in direct physical contact with the blank round chamber block and the leaf spring includes an angled portion that extends out of an ejection portion of a slide of a firearm before a blank round in the blank round chamber block is fired and the angled portion contacts an inner surface of the slide immediately after the blank round in the blank round chamber block is fired, compresses the leaf spring and moves the blank round chamber block downward into a correct load and eject position; and an ocular laser detection system comprising:

glasses worn by a user;

a laser sensor in direct physical contact with the glasses for detecting contact of the laser beam with the glasses;

a laser sensor receiver coupled to the laser sensor; and an ocular output device coupled to the sensor receiver wherein the ocular output device is actuated by the sensor receiver when the laser sensor detects the laser beam.

11. The firearm simulation system of claim 10 wherein the laser apparatus includes a compression spring fitted over the laser housing to move the blank round chamber block into a correct load and eject position.

12. The firearm simulation system of claim 10 further comprising:

a wearable laser detection system comprising:

optical pads attached to the vest for detecting the laser beam from the laser apparatus;

detector sensor electronics coupled to the optical pads; and an output device coupled to the detector sensor electronics wherein the output device is actuated by the detector sensor electronics when the optical pads detect the laser beam.

13. The firearm simulation system of claim 10 wherein the output device is a light emitting diode (LED) that is illuminated when the laser sensor detects the laser beam.

14. The firearm simulation system of claim 10 wherein the laser apparatus is part of a conversion kit that replaces a barrel and a chamber block of a firearm.

15. The firearm simulation system of claim 10 wherein the laser apparatus further comprises:

a muzzle having muzzle vents that extend through an outer cylindrical surface of the muzzle;

a coupling nut in direct physical contact with the laser muzzle and a flash suppressor on a firearm;

an audio sensor within the laser muzzle that detects audio signals wherein the is actuated when a blank round is fired;

a gas flow restrictor at least partially within the laser muzzle having a gas flow restrictor vent for restricting gas flow into the muzzle; and a laser assembly within the muzzle, the laser assembly includes a laser emitting a laser beam that is aligned with a center axis of the muzzle and an audio sensor that is coupled to the laser that actuates the laser.

16. A firearm simulation system comprising:

a laser apparatus comprising:

a blank round chamber block wherein the blank round chamber block has a pressure switch vent and an internal surface that prevents live rounds from being placed in the blank round chamber block;

a laser housing coupled to the blank round chamber block;

a laser that emits a laser beam; and an ocular laser detection system comprising:

a laser sensor for detecting the laser beam from the laser apparatus;

glasses worn by a user wherein the laser sensor is connected to the glasses and detects the laser beam contacting the glasses;

a laser sensor receiver coupled to the laser sensor; and an output device coupled to the sensor receiver wherein the output device is actuated by the sensor receiver when the laser sensor detects the laser beam.

17. The firearm simulation system of claim 16 wherein the laser apparatus includes a compression spring fitted over the laser housing to move the blank round chamber block into a correct load and eject position.

18. The firearm simulation system of claim 16 further comprising:

a wearable laser detection system comprising:

a vest worn by the user;

optical pads attached to the vest for detecting the laser beam from the laser apparatus;

detector sensor electronics coupled to the optical pads; and a wearable output device coupled to the detector sensor electronics wherein the output device is actuated by the detector sensor electronics when the optical pads detect the laser beam.

19. The firearm simulation system of claim 16 wherein the laser apparatus is part of a conversion kit that replaces a barrel and a chamber block of a firearm.

20. The firearm simulation system of claim 16 wherein the laser apparatus further comprises:

a muzzle having muzzle vents that extend through an outer cylindrical surface of the muzzle;

a coupling nut in direct physical contact with the laser muzzle and a flash suppressor on a firearm;

an audio sensor within the laser muzzle that detects audio signals wherein the is actuated when a blank round is fired;

a gas flow restrictor at least partially within the laser muzzle having a gas flow restrictor vent for restricting gas flow into the muzzle; and a laser assembly within the muzzle, the laser assembly includes a laser emitting a laser beam that is aligned with a center axis of the muzzle and an audio sensor that is coupled to the laser that actuates the laser.

21. The firearm simulation system of claim 16 wherein the laser apparatus further comprises:

a pressure switch within the laser housing that is actuated when a blank round in the blank chamber block is fired by pressurized gas that exits the pressure switch vent and enters the laser housing through vent holes wherein the laser that emits the laser beam when the pressure switch is actuated.

* * * * *